United States Patent [19]

Martin

[11] Patent Number: 4,834,699

[45] Date of Patent: May 30, 1989

[54] BUCKLE CHUTE PAPER FOLDING APPARATUS

[76] Inventor: Samuel W. Martin, Martin Rd., Weston, Conn. 06883

[21] Appl. No.: 151,934

[22] Filed: Feb. 3, 1988

Related U.S. Application Data

[63] Continuation-in-part of Ser. No. 29,786, Mar. 25, 1987, abandoned.

[51] Int. Cl.[4] ..... B31B 45/14

[52] U.S. Cl. ..... 493/421; 493/420

[58] Field of Search ..... 493/420, 421

[56] References Cited

U.S. PATENT DOCUMENTS

| | | | |
|---|---|---|---|
| 722,879 | 3/1903 | Owens | 493/420 |
| 2,143,714 | 1/1939 | Rosebush | 493/421 |
| 2,195,716 | 4/1940 | Clark | 493/420 |
| 2,703,237 | 3/1955 | Rovan et al. | 493/421 |
| 3,627,305 | 12/1971 | Heigl | 493/421 |
| 3,643,555 | 2/1972 | Ehlscheid | 493/249 |
| 4,573,672 | 3/1986 | Lehmann et al. | 493/420 |

FOREIGN PATENT DOCUMENTS

| | | | |
|---|---|---|---|
| 372166 | 5/1932 | United Kingdom | 493/249 |

*Primary Examiner*—Frederick R. Schmidt
*Assistant Examiner*—William E. Terrell
*Attorney, Agent, or Firm*—Evelyn M. Sommer

[57] ABSTRACT

An apparatus for sequentially folding paper includes a first pair of rollers which feeds the paper to a first uncovered concave buckling chute. A paper stop mechanism aligns an end of the paper in a gap between the chute and a second pair of rollers which in turn receives the document to form a first fold in the paper. The second roller pair conveys the paper to a second uncovered curved chute which coacts with a third pair of rollers to form a second fold in the paper. Use of uncovered buckle chute facilitates clearance of paper jams without requiring disassembly of the apparatus.

11 Claims, 4 Drawing Sheets

BUCKLE CHUTE PAPER FOLDING APPARATUS

This application is a continuation-in-part of application Ser. No. 29,786 filed Mar. 25, 1987, abandoned.

FIELD OF THE INVENTION

This invention generally relates to buckle chute paper folding apparatus and, more particularly, a folding apparatus which provides ready access to a paper pathway for jam clearance and apparatus maintenance.

BACKGROUND ART

Buckle chute folding machines are well known in the printing and mail service fields. Conventional buckle chutes are generally provided with straight or curved configurations which confine the paper as it is buckled and advanced to the nip of folding rollers. In machines which employ chutes having convex or straight configurations—two sided chutes—it is necessary to confine both sides of the paper to maintain it in proper orientation in the paper pathway. One sided chutes which have concave configurations confine the paper on one side.

In practice, two-sided buckle chutes must be removed or at least opened to permit the extraction of jammed or misfolded paper. As a consequence, the chutes cannot be utilized as support structures in the machine. In order to permit removal of the chutes, separate support structure must be provided to maintain the integrity of the machine. Further, when the chutes are removed, a mechanism is required to permit reinstallation of the chutes without requirement of complex tuning and adjustments.

Two-sided chutes have also proved unsatisfactory for use in precision folding operations. Conventional two-sided chute folding apparatus confine the paper as it advances into the chute and is thereafter fed into folding rollers. Confinement of the paper as it advances to the folding rollers generates a ripple in the paper which varies the length of fold panels in the paper. Correction to take account of this ripple effect requires adjustment of the chute apparatus to take account of the characteristics of the paper and environmental factors such as humidity.

Fixed two sided chutes permit a less expensive, folding machine design since the base of the chutes can be utilized to space and secure side frames of the machine together. However, such machines have not proved entirely satisfactory in that they do not permit ready access to the paper pathway for jam clearance. Moreover, such fixed chute arrangements generally require the operator to reverse the direction flow of paper in the machine to clear a paper jam.

The present invention is directed to a one-sided open buckle chute apparatus which advances the prior art by being less expensive and by providing ready access to a paper pathway for jam clearance. An open chute design provides further advantage by facilitating use of the apparatus to effect secondary operations on the paper. For example, as the paper travels through the folding stations of the apparatus, the open chute design permits application of glue to paper folds.

Accordingly, it is a broad object of the present invention to provide an improved buckle chute paper folding apparatus of compact design which effects precision paper folds.

A more specific object of the invention is to provide a paper folding apparatus in which access to the paper pathway for jam clearance is readily effected without removal or disassembly of buckle chutes and access covers for economies in maintenance and manufacture.

A further object of the invention is to provide a paper folding apparatus in which paper jams may be readily cleared without readjustment of fold mechanisms.

A still further object of the invention is to provide an open buckle chute apparatus which provides ready access to paper during folding operations to facilitate performance of secondary paper operations.

DISCLOSURE OF THE INVENTION

In the present invention, these purposes, as well as others which will be apparent, are achieved by providing a folding apparatus including means for inputting documents sequentially, such as a feed deck, a frame, a combination of four paper conveying and folding rollers rotatably supported in the frame, and guide means for the documents.

The combination of rollers include, a first pair of rollers for receiving and conveying the documents, a second pair of rollers for producing a first fold in the documents, a third pair of rollers for producing a second fold in the documents, a central support roller which is common to the first, second and third pairs of rollers, and means for driving the roller combination.

The guide means includes first and second concave buckle chutes and means for stopping the forward movement of the documents in each chute to form folds. The first chute receives the documents at an upstream end of the chute and is configured so that the leading edge of each document slides along and frictionally engages the chute surface. The first chute is oriented at a generally obtuse angle with respect to the nip of the first roller pair and is spaced from the first and second pairs of rollers to form a gap between those rollers. A leading end of each document bridges the gap prior to intercepting the upstream end of the chute. Each document impinges upon or intercepts the buckle chute at an angle which causes it to deflect along the surface of the chute. The document slidably continues along the feed path, while being pushed by the first roller pair, until the leading end of the document abuts against an inwardly bent stop. The stop halts forward movement of the document while a small section of an intermediate portion of the document buckles toward the gap, enabling the second pair of rollers to trap the buckle and produce the first fold.

The second chute which is oriented in a generally perpendicular relation to the first chute receives the first fold of each document at an upstream end. The second chute is spaced from the second and third pairs of rollers. A folded leading end of the document bridges the second gap prior to intercepting the upstream stop of the second chute. The document impinges upon or intercepts the second chute at an angle which causes the document to deflect along the surface of the second chute in frictional contact with the chute surface. Each document is pushed by the second pair of rollers until the folded end abuts against the inwardly bent stop on the chute causing the document to buckle toward the second gap, enabling the third pair of rollers to produce the second fold.

In a preferred embodiment the buckle chutes are uncovered to facilitate access to the paper pathway. The buckle chutes are also provided with adjustable stops which extend outwardly from their upstream ends to permit variation in the chute dimensions and document sizes which they can accommodate. The adjustable stops include slidable extensions which have the same curvature as each chute and screw locking knobs.

Advantage is obtained in the invention by employing chutes having a concave curvature which assures that paper is properly aligned and compressed against the chute for buckling and engagement with the folding rollers at a selected fold line. Frictional arrangement of the paper on the chute also prevents the paper from fluttering to reduce noise in operation of the apparatus.

BEST MODE OF CARRYING OUT THE INVENTION

Figure 1:
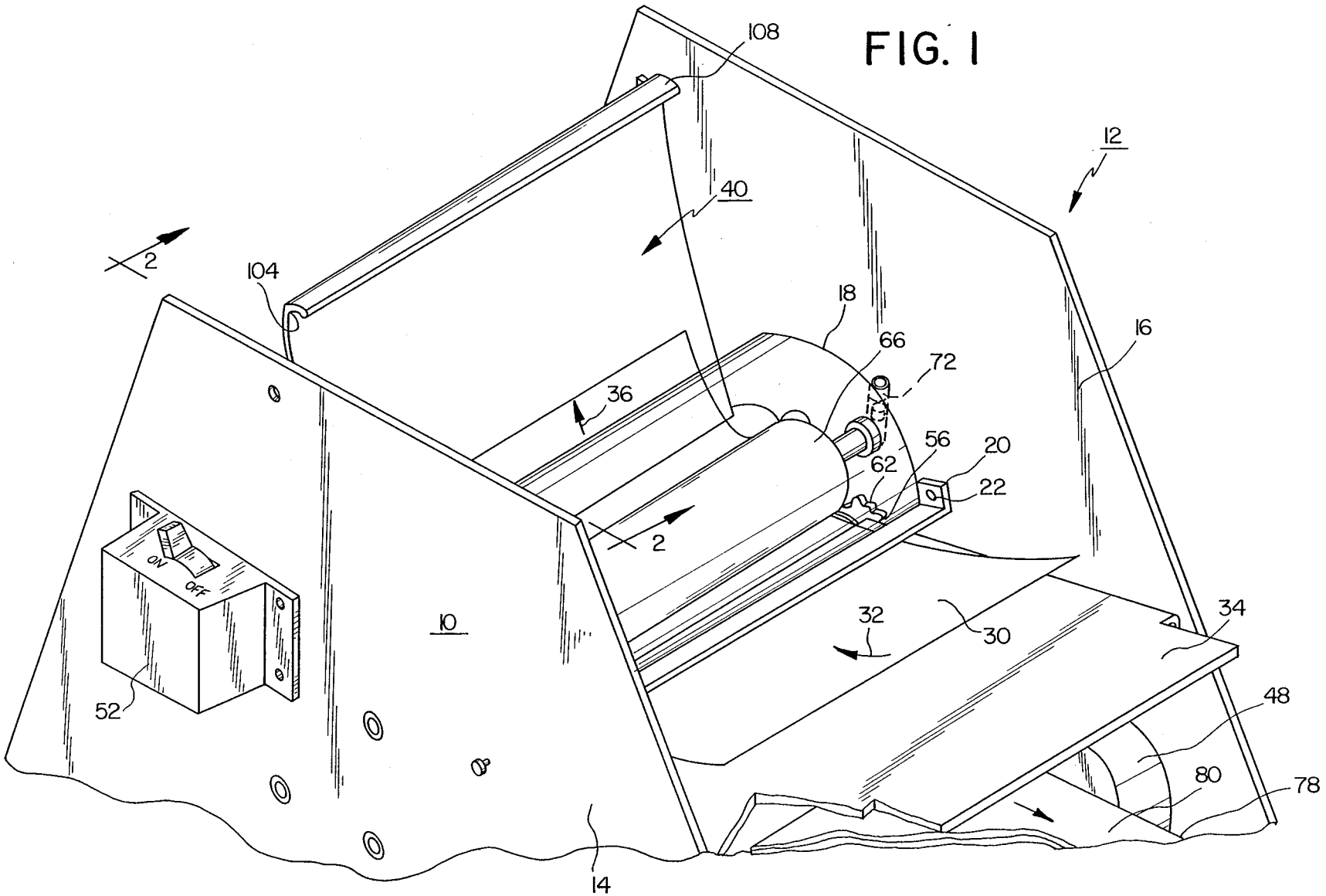
FIG. 1 is an overhead partial isometric view of the folding machine of the present invention.

Referring to FIG. 1, there is shown a folding machine 10 having a frame 12. The frame 12 is formed of two upstanding frame members which constitute a structure for the machine 10 including, a front frame 14 and a rear frame 16. It will be evident to those skilled in the art, that a U-shaped frame is being utilized to space the front frame 14 and rear frame 16 apart, while providing suitable mounts for a combination of folding rollers 44, a motor 48 and other operative components which will be described further in the following specification.

The frames 14, 16 are suitably connected together by appropriate elongate laterally disposed members, including an operator safety cover 18. The cover is clear or translucent, and is fabricated of a suitable plastic, which provides a structural member. It will be noted that it is provided only for operator safety as is required by UL and other safety agencies. The cover 18 has a tab 20, which receives a suitable screw 22 through an appropriate locating hole in the rear frame 16. There is a corresponding tab (not shown) on the front side of the machine 10, and that tab is similarly fastened to the front frame 14.

A document 30 is shown being fed forward from an input means along a feed path 32, which leads into the machine 10. The input means includes a feed deck 34 which is secured to the front and rear frames 14, 16 in the manner of the cover as illustrated in FIG. 1. A leading end 36 of the document 30 is guided upwardly along a first curved and uncovered buckle chute 40. The first chute 40 is suitably fastened to the front frame 14 and rear frame 16 in a manner similar to that described, heretofore, with respect to the cover 18 and the feed deck 34. It is pointed out that the first chute 40 is formed of a material which is suitable for receiving a wide range of document types with minimal frictional resistance to the guiding and conveyance of the documents. More details of the first chute's geometry and contribution to the present invention will be discussed later in this specification.

Figure 2:
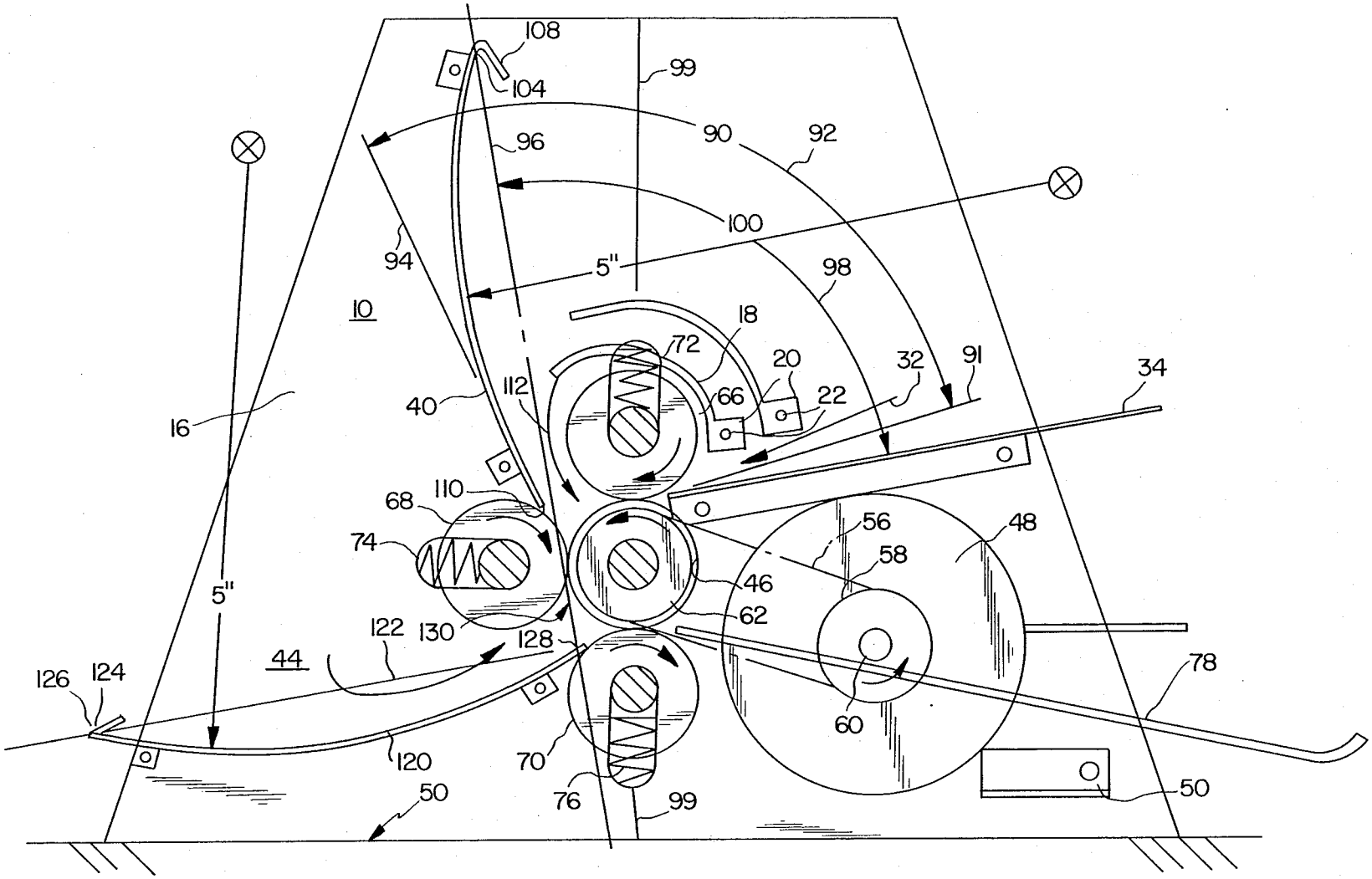
FIG. 2 is a front side view taken along the line 2—2 of FIG. 1.

Referring now to FIG. 2, more details of the machine 10 are seen, including a combination of four folding rollers 44 including a common drive roller 46 which has a suitable elastomer covering, and which is further rotatably journaled in the frames 14, 16, while being connectively engaged to a drive motor 48. The drive motor is secured to the frames 14, 16, and is secured thereto by means described, heretofore, with respect to the cover 8, the deck 34, and so forth. The motor 48 is firmly mounted with appropriate screws, and is electrically connected to an operator on and off switch 52 seen in FIG. 1.

The motor 48 has a drive member 56 connected to a sprocket 58 mounted on a motor output shaft 60. The member 56 also engages a suitable sprocket 62 located on a rear end of the common roller 46 for rotation therewith. A roller 66 and the common roller 46 form a first pair of rollers. A roller 68 and a roller 70 combined with the common roller 46, respectively, form second and third pairs of rollers. A third pair of rollers is formed by the common roller 46 and a roller 70. Each of the rollers, 66, 68 and 70 is biased by a suitable spring 72, 74 and 76 which will be understood to be located at lateral ends of the rollers 66, 68 and 70, so as to impose a yielding pressure upon each roller pair. The biased combination of rollers is understood by those skilled in the art to enable the sequential building of layers of each document being folded, during the process, while ensuring that the document continues feeding along the feed path 32. The feed path 32 is understood to be a one way path, the purpose of which is to deliver the folded document to the operator.

To this end, there is a receiving platform 78 located at the output end of the machine 10, and when referring to FIG. 1, a folded document 80 is seen resting on the platform 78. Referring back to FIG. 2, more details of the first buckle chute 40 are evident and are now described. The member 40 is seen to have a curved shape, and specifically has a radius of 5 inches, the center of which is geometrically located along the nip of the roller combination of rollers 46 and 66 and the feed deck 34, and also with respect to the member 40, to the right thereof. When the chute 40 is observed in FIG. 2, it is seen that it lies at a substantially obtuse angle 90, as indicated by an arcuate dimension line 92. The obtuse angle 90 is defined as the angle between a tangent line 94, and a tangent line 91 to the point of contact between the rollers 66 and 46. The angle 90 has been found to be effective between 110 degrees and 120 degrees. There is a line 96, that is defined by an arcuate dimension line 98, which is substantially 90 degrees or a right angle 100, with respect to the deck 34. The line 96 defines the upper location of the chute 40, since there is an intersection point 104, defined by the line 96, and the arcuate surface of the chute 40. At the distal end of the chute 40, a flange 108 serves as an abutment which stops the leading end of the aforementioned document. The angle of the flange is bent over the inside surface of the chute 40 to ensure that the end of the document does not escape from the chute 40 during the abutting stage. A lower end 110 of the chute 40 is positioned just above the roller 68, such that, there is a gap 112 between the first pair of rollers 66 and 46, and the second pair of rollers 68 and 46.

Further downstream in the machine 10, there is a second curved and uncovered chute or guide member 120, which has a radius, in this particular embodiment of 5", a geometric center of which is located in an area approximately midway between the deck 34 and the chute 120. The 5" radius is not a critical dimension. The chute 120 lies at a substantially right angle with respect to the first chute 40. It should be understood that it is possible to vary the angular relationships between the first and second chutes 40, 120 to achieve the objects of the present invention. The essential angles of the document chutes being described here are found to be tolerant of a wide range of documents having varying degrees of stiffness and caliper. The arrangement being described is highly efficient and reliable. The member 120 has an abutment or flange 126, which serves to stop the forward motion of the documents which at this stage have been folded once. The second chute 120 has essentially the same physical dimensions as the first chute 40, and is fastened in the same way to the frames 14, 16. There is a dimensioned extension line 122, shown in FIG. 2, which intersects the flange 126 at a point 124, and which can be seen to be substantially parallel to the deck 34. The flange 126 is formed to ensure capture of the document in process to stop its forward motion. An end of the second chute 120 is located adjacent the roller 70 and the second pair of rollers 68 and 46, such that there, is a gap 130 between the rollers 68 and 46 and the third pair of rollers 70 and 46.

Summarizing rollers 46, 66, and 70 lie along a substantially vertical line 99. Roller 68 lies at an approximately 90 degree relationship to the line 99. Furthermore, the first and second chutes 40, 120 must maintain a 90 degree relationship to one another and a fixed rotational angular displacement from the line 99.

Operation Of The Machine

Figure 3:
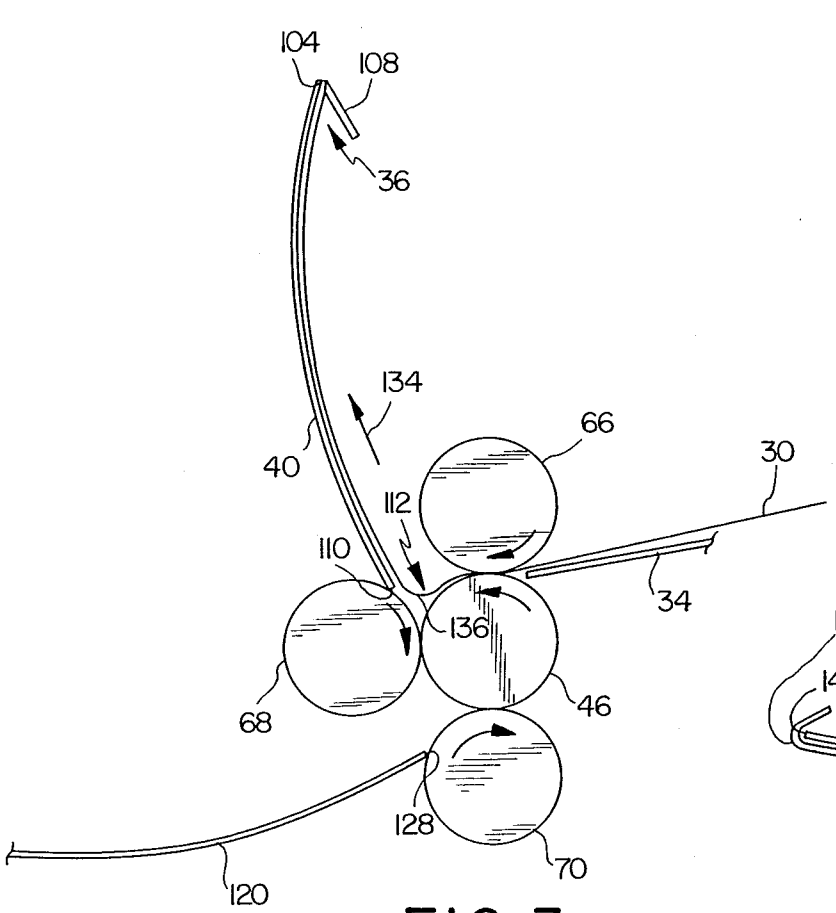
FIG. 3 is a side cross-sectional view of the folding machine showing a document abutting a stop on a first buckle chute forming a buckle in a gap defined between first and second pairs of feed rollers.

Referring again to FIGS. 1 and 3, the machine operator switches the switch to the on position, causing the motor 48, which is connected to a 115 VAC power source (not shown) to energize. The drive member 56, through sprocket 62, immediately causes the common roller 46 to rotate in a counterclockwise direction, and the cooperating rollers 66, 68 and 70 rotate clockwise in contact with the roller 46. The document 30 is accepted into the nip defined between the roller 46 and the roller 66 at the leading end 36 of the document. The document 30 is intercepted initially by the end point 110 of the first chute 40, causing the end 36 to be guided along the curved surface of the member 40 in a direct line 134. The document 30 is pushed until the end 36 abuts the flange 108 at the point 104. Immediately following the end 36 impact of point 104, a buckle 136 forms in the document 30. The buckle 136 formed in the gap 112, bulges towards the second pair of rollers 68 and 46. The nip between the rollers 68 and 46 then causes a first fold 138. The tangential velocity of the rollers 66 and 46 has been found to be effective at least at about 30 inches/-second (IPS). This is pointed out because it is critical to maintain sufficient speed, and thus momentum of the document, while it is being deflected along the curved guides described heretofore. Speeds greater than 30 IPS are normally employed. The entire process is dependent on the geometric nature, and the geometric relationship of the components as described. The results are to obviate the need for buckle chute covers.

Figure 4:
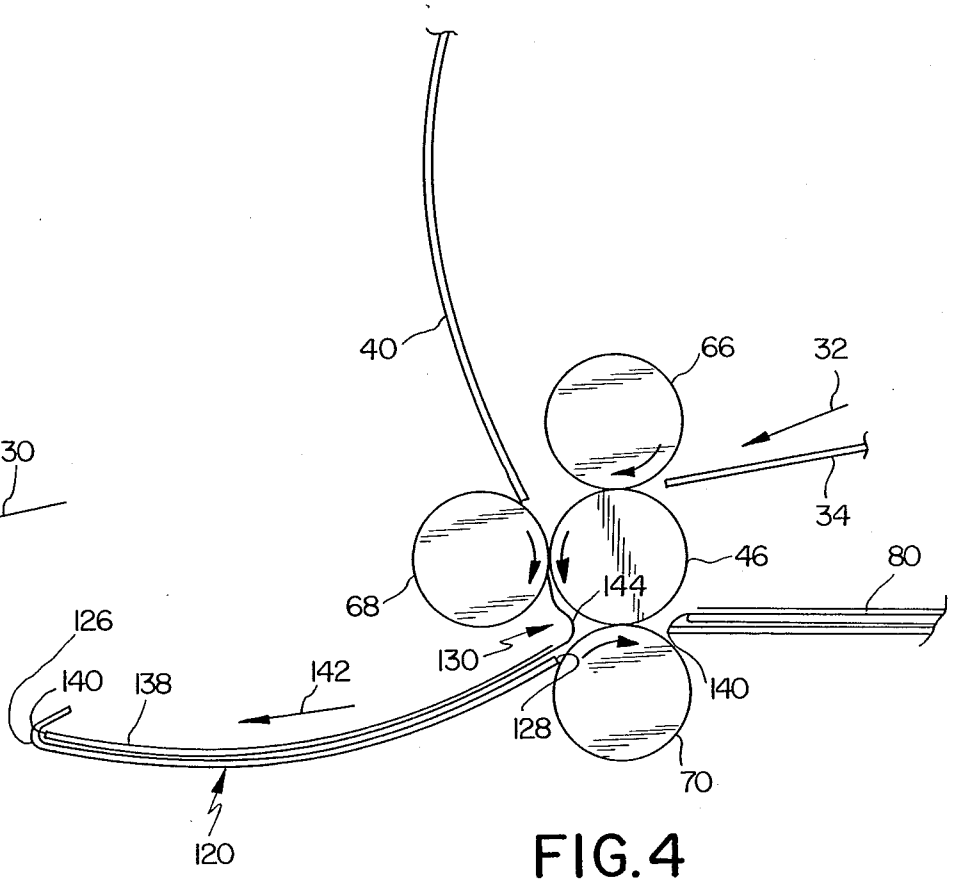
FIG. 4 is a cross-sectional view similar to FIG. 3, showing the document abutting a second stop on a second buckle chute, forming a buckle in a gap defined between second and third pairs, of feed rollers.

Referring again to FIG. 4, the document 30 continues along a path 142. And, the fold 138 has a new end 140, which is intercepted then by the end point 128 of the second chute 120. The end 140 is guided along the curved path of the second chute 120, in a direction 142, until it abuts against the flange 126, thereby causing a second buckle 144 to form in the gap 130, between the roller 70 and 46. The second fold is immediately generated, which represents the finished and folded paper product.

Figure 5:
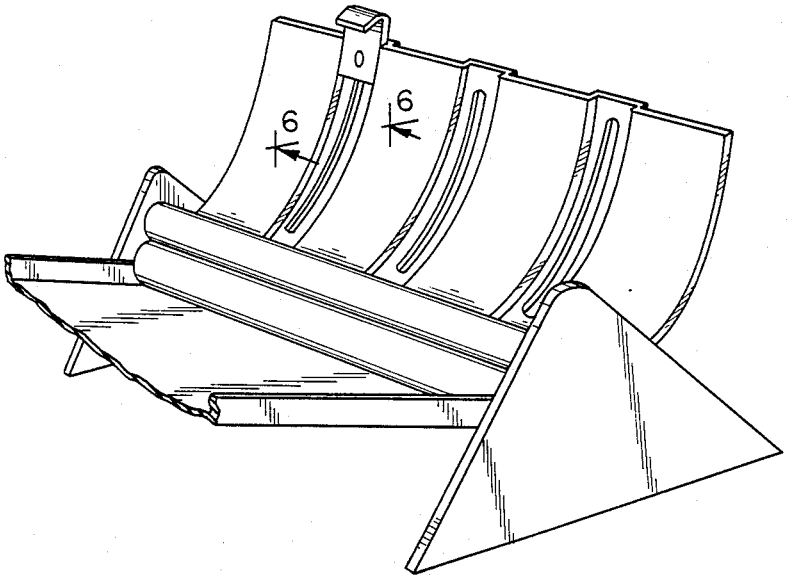
FIG. 5 is a perspective view of an alternative embodiment of the buckle chute of the invention including an adjustable stop.
Figure 6:
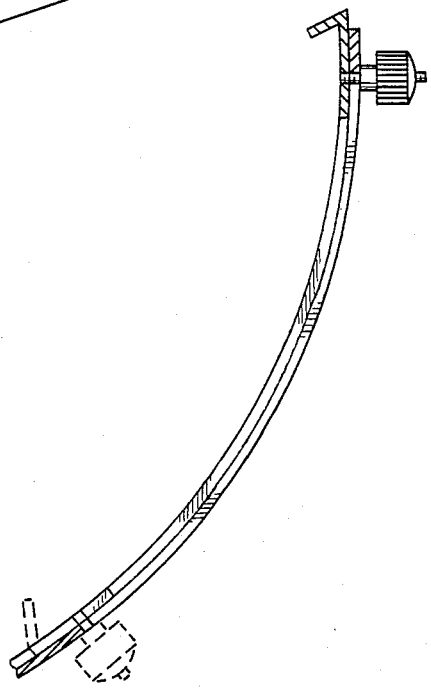
FIG. 6 is a cross-sectional view through FIG. 5 showing the manner in which the adjustable stop can be inverted for small size paper.
Figure 7:
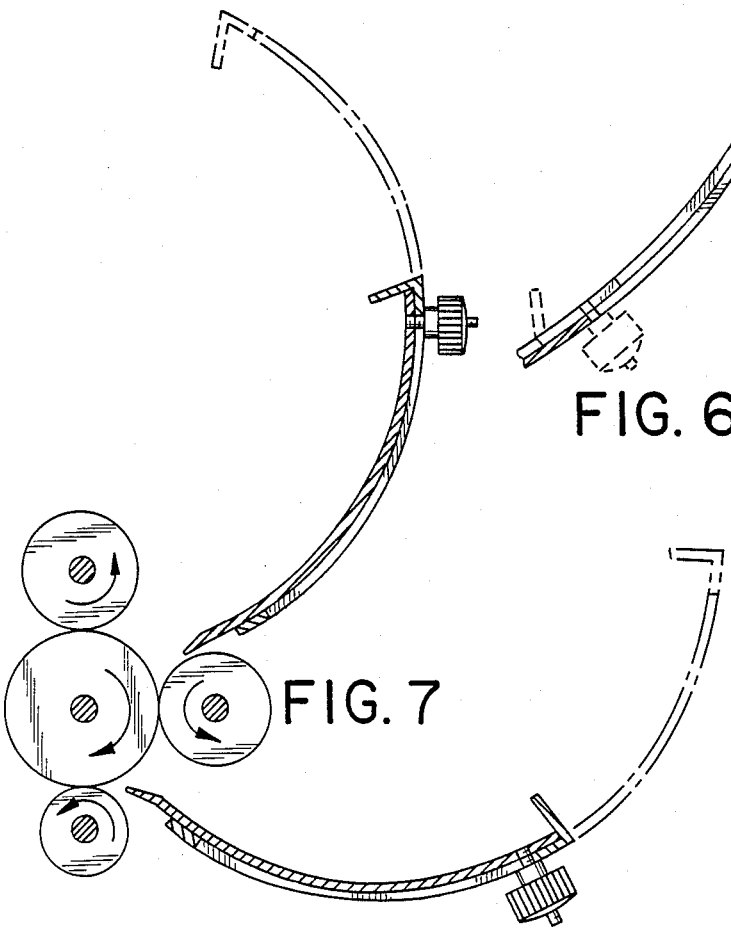
FIG. 7 shows a second alternative buckle chute design including an adjustable stop.

It will be recognized that buckle chutes 40, 120 and their respective flange members 108, 126 are designed to accommodate fixed paper lengths. FIGS. 5–7 illustrate alternative guide means in accordance with the invention which permit adjustment of the paper lengths which the folding apparatus can accommodate.

The alternative guide means include third and fourth buckle chutes 150 which respectively have curvatures and orientations of the first and second chutes. FIGS. 5 and 6 illustrate the third chute; the fourth chute which is not shown has the same configuration.

Each chute includes one or more recessed elongated slots 152 oriented in the paper path direction which are closed at both ends. An adjustable paper stop means is slidably disposed in the elongated slots 152 for adjusting the dimensions of the buckle chutes 150. FIGS. 5 and 6 show a first stop means design which includes an extension 154 having an inturned paper stopping flange 156, and screw locking knob 158 for adjustable positioning of the extension 154. The extension 154 is provided with the curvature of the chutes 150.

In order to assure proper alignment of the paper on the chutes it is preferable to employ spaced slots 152 and extensions 156 across the buckle chutes 150 as illustrated in FIG. 5. The extensions are aligned through use of a coupling bar (not shown) which is locked in position by the knobs 160.

The extensions 154 may be dimensioned to accommodate a range of paper sizes. For example, FIG. 6 shows (in phantom) the manner in which the extensions may be removed from the elongated slots 152, turned upside down, and reinstalled to accommodate small sized paper. FIG. 7 shows an alternative buckle chute 170 and extension 172 which is slidably attached to an exterior side of the buckle chute. The extension 172 has an elongated configuration for use with large paper sizes.

From the foregoing it will be appreciated that the present invention provides a paper folding apparatus 10 which achieves the objects stated heretofore. In particular, a folding apparatus is provided which includes buckle chutes 40, 120 having radiused curvatures and aligned orientations relative to folding rollers 66–70, 46 to assure reliable folding operations without complex adjustments. Advantageously, the buckle chutes are fixed in position to further the structural integrity of the apparatus while affording ready access to the paper pathway for clearing paper jams.

Numerous modications are possible in light of the above disclosure. For example, the drawings show a folding apparatus including two uncovered and open buckle chutes which coact with folding rollers. It will be appreciated that additional rollers and buckle chutes may be employed in accordance with the invention to make additional folds. Concave chutes which are partially or fully covered are within the scope of the invention. Similarly, those skilled in the art will appreciate that the folding apparatus may be used in line with conventional paper feeders and stacking devices.

Therefore, although the invention has been described with reference to certain preferred embodiments, it will be appreciated that other folding apparatus may be devised, which are nevertheless within the scope and spirit of the invention as defined by the claims appended hereto.

I claim:

1. A buckle chute folding apparatus having a feed path for producing folds in documents which comprises:

a frame;

means for inputting documents along the feed path into said frame;

a roller combination rotatably supported in said frame for conveying and folding documents fed sequentially along the feed path, said roller combination including a first pair of rollers for receiving and conveying said documents along the feed path from said means for inputting documents, and a second pair of rollers for producing a first fold in said documents, said roller combination further being arranged such that a central support roller is common to said first and second pairs of rollers;

means for driving said roller combination; and a first one-sided, concavedly curved buckle chute for sequentially receiving said documents from the first pair of rollers, said buckle chute having an upstream end which is spaced from said first and second pairs of rollers to define a gap therebetween, a downstream end which includes stop means for intercepting a leading end of a document fed along said first buckle chute, and a one-sided concavedly curved surface extending between said upstream and downstream ends for guiding the document fed along said first buckle chute, said documents each being fed by said first pair of rollers with its leading end bridging said gap to contact said upstream end of said first buckle chute and being guided along said one-sided surface by substantially only the concave curvature of said one-sided surface to said downstream end of said first buckle chute, wherein the leading end of the document is intercepted by said downstream end and the document becomes stopped along said first buckle chute and an intermediate portion of the document becomes buckled in the gap for engagement with said second pair of rollers and formation of the first fold.

2. A buckle chute folding apparatus according to claim 1, further comprising:

a third pair of rollers for producing a second fold in said document, said third pair including said central support roller in common with said first and second roller pairs, and a second one-sided, concavedly curved buckle chute for sequentially receiving said documents from said second pair of rollers, said buckle chute having an upstream end which is spaced from said second and third pairs of rollers to define a second gap therebetween, a downstream end which includes stop means for intercepting the first fold of the document fed from said second pair of rollers, and a one-sided concavedly curved surface extending between said upstream and downstream ends for guiding the document fed along said second buckle chute, said documents each being fed by said second pair of rollers with its first fold bridging said second gap to contact said upstream end of said second buckle chute and being guided along said one-sided surface by substantially only the concave curvature of said one-sided surface to said downstream end of said second buckle chute, wherein the first fold of the document is intercepted by said downstream end and the document becomes stopped along said second buckle chute and another intermediate portion of the document becomes buckled in the gap for engagement with said third pair of rollers and formation of the second fold.

3. A folding machine according to claim 1, wherein said first buckle chute is arranged so that substantially all of said one-sided surface is exposed externally from said frame to provide access to the feed path externally from said frame.

4. A folding machine according to claim 2, wherein said first buckle chute is oriented at an obtuse angle of between 110 and 120 degrees, said obtuse angle being defined by the intersection of lines respectively tangent to said first chute and a point of contact between said first roller pair.

5. A folding machine according to claim 4, wherein said first and second buckle chutes are arranged so that substantially all of said one-sided surfaces of the respective buckle chutes are exposed externally from said frame to provide access to the feed path externally from said frame.

6. A folding machine according to claim 5, wherein said first and second buckle chutes are disposed at an approximately ninety degree offset relationship to one another.

7. A folding machine according to claim 6, wherein said first and second buckle chutes have generally uniform radii of 5 inches, the center of which is located in an upstream position with respect to said feed path.

8. A buckle chute folding apparatus including a feed path for producing folds in documents which are fed sequentially to said apparatus, said apparatus comprising:

first, second, and third pairs of rollers for conveying documents sequentially along the feed path and for forming first and second folds therein;

a first one-sided, concavedly curved and uncovered buckle chute for receiving said documents at an upstream end of said first chute which is spaced from first and second pairs of rollers to define a first gap therebetween, said first buckle chute having a downstream end which includes an inwardly bent flange for intercepting a document fed along said first buckle chute, and a one-sided concavedly curved surface extending between said upstream and downstream ends for guiding the document fed along said first buckle chute, each document including a leading end which bridges the first gap prior to intercepting said upstream end of said first buckle chute, said document bridging the first gap at an angle which causes the document to deflect along the one-sided concavedly curved surface of said first buckle chute, after which an intermediate portion of the document maintains intimate contact with said first buckle chute and is pushed by said first pair of rollers until said document abuts against said inwardly bent flange at said downstream end of said first buckle chute, said flange stopping movement of said document and causing a portion of said document to buckle towards said second pair of rollers, thereby enabling said second pair of rollers to produce said first fold;

a second one-sided, concavedly curved and uncovered buckle chute which receives said first fold of each said documents at an upstream end of said second chute which is spaced apart from said second pair and a third pair of rollers, thereby defining a second gap between said second and third pair of rollers, said second buckle chute having a downstream end which includes an inwardly bent flange for intercepting the first fold of the document fed from said second pair of rollers, and a one-sided concavedly curved surface extending between said upstream and downstream ends for guiding the document fed along said second buckle chute, wherein a folded leading end of said documents bridges said second gap, prior to intercepting said upstream end of said second buckle chute, at an angle which causes the document to deflect along the one-sided concavedly curved surface of said second buckle chute, after which another intermediate portion of each document maintains intimate contact with said second buckle chute and is pushed by said second pair of rollers until said folded end of said document abuts against said inwardly bent flange of said second buckle chute, said flange thereby stopping forward movement of said document while another portion of said document buckles toward said third pair of rollers, thereby enabling said third pair of rollers to produce said second fold; and means for driving said first, second, and third pairs of rollers, wherein each said document is guided along each said one-sided surface of the respective buckle chutes by substantially only the concave curvature of said one-sided surface thereof, and said first and second buckle chutes are uncovered and expose substantially all of said one-sided surfaces of the respective buckle chutes externally from said apparatus to provide access to the feed path externally from said apparatus.

9. A folding machine according to claim 8, wherein said inwardly bent flange of said first and second buckle chutes are bent at a substantially acute angles relative to said chutes.

10. A folding machine according to claim 1, wherein said first buckle chute includes an elongated slot and further comprises an adjustable paper stop means for adjusting the position of said flange of said first buckle chute, said stop means including an extension which slidably engages said elongated slot.

11. A folding machine according to claim 8, wherein said first and second buckle chutes each include an elongated slot and further comprise an adjustable paper stop means for adjusting the positions of the respective flanges of said first and second buckle chutes, said stop means including an extension which slidably engages each elongated slot.

* * * * *